US007406798B2

(12) United States Patent
Barrett

(10) Patent No.: US 7,406,798 B2
(45) Date of Patent: Aug. 5, 2008

(54) FLORAL ARRANGING VASE COVER

(76) Inventor: James J. Barrett, 23721 Arjay Way, Laguna Niguel, CA (US) 92677

( * ) Notice: Subject to any disclaimer, the term of this patent is extended or adjusted under 35 U.S.C. 154(b) by 402 days.

(21) Appl. No.: 11/063,701

(22) Filed: Feb. 22, 2005

(65) Prior Publication Data

US 2006/0185231 A1 Aug. 24, 2006

(51) Int. Cl.
*A01G 5/00* (2006.01)
*A47G 7/00* (2006.01)

(52) U.S. Cl. ..... 47/41.11; 47/41.01

(58) Field of Classification Search ..... 47/41.11, 47/41.12, 41.13, 41.01, 39, 41.1, 41.14; 211/85.23, 211/164, 163; 248/318
See application file for complete search history.

(56) References Cited

U.S. PATENT DOCUMENTS 353,131 A * 11/1886 Greenwood ..... 248/318
1,524,300 A * 1/1925 Gottlieb ..... 211/163
1,958,790 A * 5/1934 Jippson ..... 47/41.1
2,005,966 A * 6/1935 Beagle ..... 47/41.13
6,061,955 A * 5/2000 Domstein ..... 47/41.01

* cited by examiner

*Primary Examiner*—Michael R. Mansen
*Assistant Examiner*—Monica L Williams
(74) *Attorney, Agent, or Firm*—Russo & Duckworth, LLP

(57) ABSTRACT

A floral arranging vase cover provides enhanced decoration and for supporting floral arrangements within a vase. The floral arranging cover includes a circular ring, inner bands and outer bands. Preferably, the floral arranging cover includes four to twelve inner bands which are arcuate in shape and have first and second ends which rotatably affix to the circular ring. The outer bands are also arcuate in shape and include first and second ends which attach to the circular ring. Preferably, the outer bands project outwardly from the ring and are arranged in an overlapping manner. Moreover, the outer bands are preferably affixed to adjacent bands to prevent their rotation about the circular ring. The floral arranging cover is placed upon a vase with the circular ring substantially adjacent to the vases' rim. The inner bands project inwardly to form a grid-like structure having openings for floral and plant stems. The outer bands project outwardly from the vase to support the floral arranging cover upon a vase and provide enhance decoration for the entire assembly. In addition, decorative elements may be affixed to the outer band to provide still additional ornamentation.

4 Claims, 3 Drawing Sheets

FLORAL ARRANGING VASE COVER

BACKGROUND OF THE INVENTION

The present invention relates generally to plant and floral arranging aids. More particularly, the present invention relates to a floral arranging aid for vases which provide enhanced ornamentation and support for flowers within a vase.

Various constructions have been utilized for supporting flowers and maintaining flowers erect in a vase. These constructions have primarily been grid-type structures which include a variety of apertures for placement of floral stems. A typical floral grid is circular and made of plastic and sized to cover the top surface of a vase. The circular end includes a plurality of circular or square holes for receipt of flower stems. The grid may be attached to the vase using an adhesive or tape. Unfortunately, these grids are typically sized to fit only one size of vase and do not provide any decorative enhancement for the floral arrangement.

An example of a grid floral-arranging aid is described in U.S. Pat. No. 5,758,452. The aid includes a circular body having a plurality of apertures for holding flower stems. In addition, the grid openings are coded for cross-referencing purposes and the aid includes a plurality of tabs which bend downwardly for engaging the sidewalls of a vase. Meanwhile, U.S. Pat. No. 5,477,637 also describes a grid-type structure for holding flower stems. The grid is circular and includes a plurality of openings. In addition the flower stems are tied at their bottom extremities in a way so as to make the bouquet appear larger than standard bouquets.

Unfortunately, the prior grid floral arranging aids suffer from numerous drawbacks. The grids are sized to cover only one size of vase opening. In addition, the floral arranging aids are particularly unsightly and do not provide for the addition of any ornamental features for further enhancing the beauty of a floral arrangement.

Thus, it would be highly desirable to provide a floral arranging device which is capable of mating to vases of various sizes.

It would also be desirable to provide for a floral arranging device which is highly decorative and pleasing to the eye.

In addition, it would be desirable for the floral arranging device to provide a structure for affixing additional ornamental elements.

Moreover, it would be advantageous to provide a floral arranging device that maintained the floral arrangement in a desired manner during floral removal from and reinsertion into a vase for the rapid replacement of water.

SUMMARY OF THE INVENTION

The present invention addresses the aforementioned disadvantages by providing an improved floral arranging cover for vases.

A traditional vase includes one or more sidewalls, a bottom, an opening at its top and a central reservoir. A vase can take any number of shapes. For example, a substantially cylindrical vase will include a single concentric side wall, and will typically include a flat bottom for placement on flat surfaces. In addition to cylindrical vases, vases come in a variety of shapes including those with curved surfaces and a plurality of sides to form vases having cross-sections which are polygonal. In addition, vases come in a variety of sizes from only a few inches in diameter to several feet.

The floral arranging vase cover of the present invention includes a circular ring having a diameter which is preferably sized similar to the size of the vase opening. In addition, the floral arranging cover includes a series of arcuate inner bands and a series of arcuate outer bands. Each of the inner bands include first and second ends which rotatably attach to the floral arrangement cover's circular ring. The rotatable attachment may be accomplished by simply wrapping the ends of the arcuate inner bands around the circular ring. Thus, the inner bands forms substantially semi-circular structures which project towards the center of the ring and are capable of rotating almost 360 degrees around the ring.

Virtually any number of inner bands may be provided. However, it is preferred that the floral arrangement cover include between four and twelve inner bands. Moreover, the inner bands may be positioned side-by-side. However, it is preferred that the inner bands overlap one another.

Meanwhile, the floral arranging cover of the present invention preferably includes the same number of outer bands as inner bands. The outer bands are acuate members which include first and second ends. The outer bands are fixed to the circular ring in similar manner as the inner bands. The outer bands may also be rotatably attached to the circular ring. However, it is preferred that the outer bands do not rotate. To this end, it is preferred that the outer bands overlap one another and be affixed to one another where they engage using a wire wrap or the like.

The circular ring, inner bands and outer bands may be made from a variety of materials. However, it is preferred that each of these structures be made from a stainless steel wire.

In operation, the floral arranging cover is placed upon a flower vase with the circular ring substantially adjacent to the vase's top rim. The inner bands project inwardly forming a grid having a plurality of openings for receipt of flower stems and plant stems. The inner bands may be rotated downwardly to engage the interior sidewalls of the vase to provide support for the floral arrangement cover. Advantageously, the circular ring of the floral arranging cover may be larger or smaller than the vase opening and the inner bands can be rotated to engage the vase inner sidewalls so as to provide floral support for a variety of vase sizes.

Meanwhile, the outer bands of the floral arranging cover project outwardly from the vase rim. Preferably, the floral arranging cover is sized so that the outer bands also rest upon the vase rim providing additional support for the floral arranging cover and floral arrangement within the vase. The outer bands project outwardly to provide a decorative appearance. Moreover, the bands provide a support structure for which decorative elements can be attached.

In use, the floral arranging cover facilitates the arranging of flowers and other plants within a vase by firmly maintaining plant stems in desired positions. In addition, the cover enables a person to quickly change the vase's water by allowing a person to remove and replace the floral arrangement from the vase without disrupting its structure.

Accordingly, it is a principle object of the present invention to provide a floral arranging vase cover which can be used with a variety of vases.

It is an additional object of the present invention to provide a floral arranging vase cover which is more pleasing to the eye than previous structures.

It is still an additional object of the present invention to provide a floral arranging vase cover which provides structure for attachment of additional decorative elements.

Furthermore, it is an object of the present invention to provide a floral arranging vase cover that made change water within a vase more simple and rapid.

These and other further and more specific objects and advantages of the invention will be apparent to those skilled in the art from the following detailed description taken in conjunction with the drawings.

DETAILED DESCRIPTION OF THE INVENTION

Figure 1:
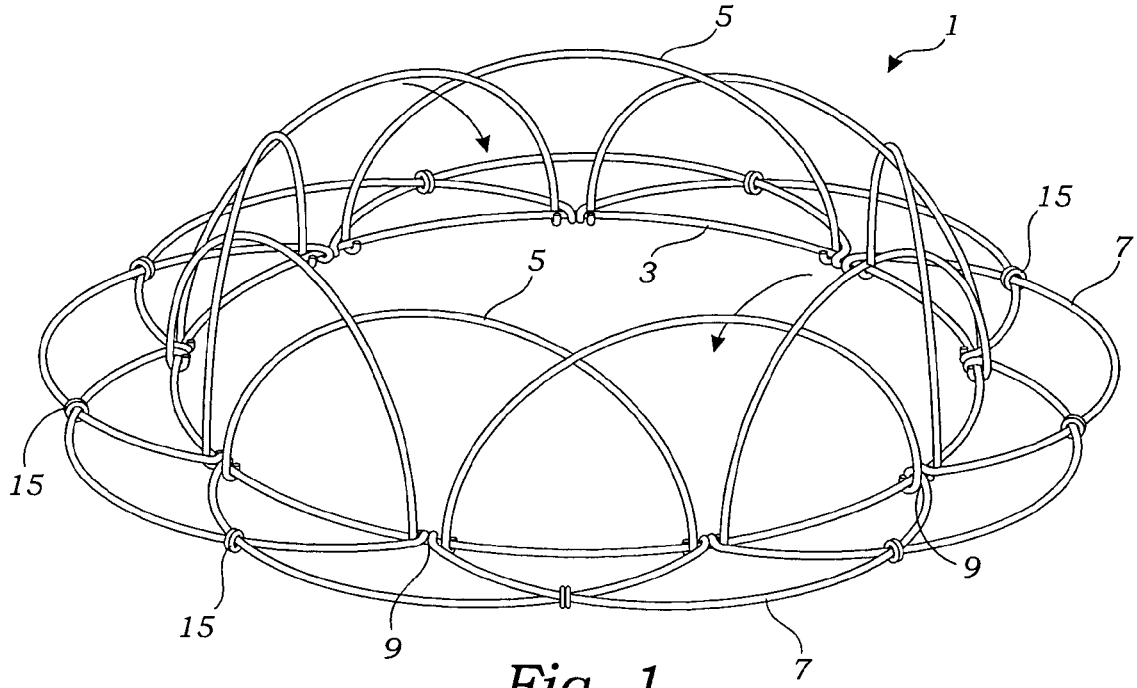
FIG. 1 is a perspective view of the floral arranging cover of the present invention with the inner bands rotated in upward manner.

While the present invention is susceptible of embodiment in various forms, as shown in the drawings, hereinafter will be described the presently preferred embodiments of the invention with the understanding that the present disclosure is to be considered as an exemplification of the invention and it is not intended to limit the invention to the specific embodiments illustrated.

Figure 2:
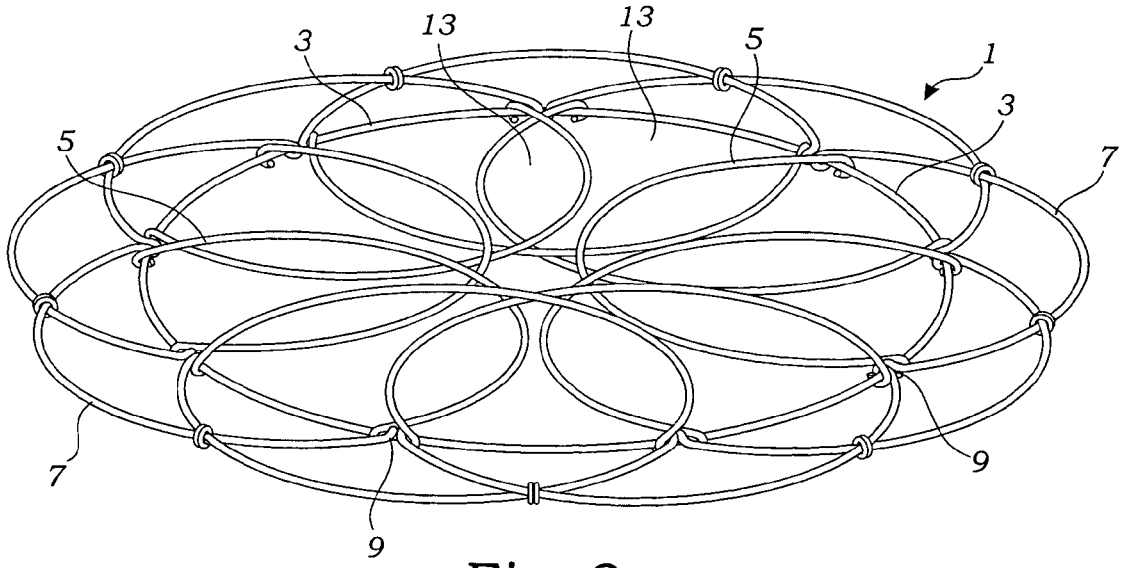
FIG. 2 is a perspective view of the floral arranging cover of the present invention with the inner bands rotated so as to be in a planar arrangement.
Figure 4:
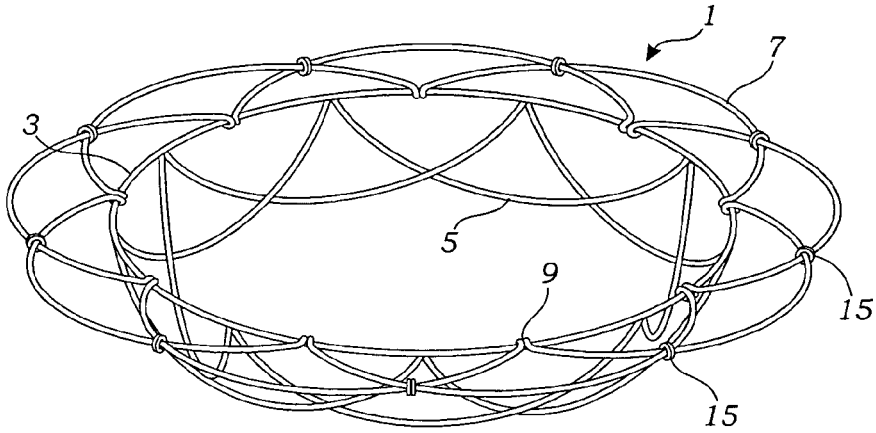
FIG. 4 is a perspective view of the floral arranging cover of the present invention with the inner bands rotated in a downward manner.

As best shown in FIGS. 1, 2, and 4, the floral arranging cover 1 of the present invention includes a circular ring 3, inner bands 5 and outer bands 7. Each of these elements are preferably made from extruded wire which is corrosion-resistant. For example, each of these elements may be made from plastic or a plastic coated metal wire. However, for aesthetic and corrosion reasons, it is preferred that floral arranging cover be made from an extruded stainless steel wire.

As shown in FIGS. 1, 2, and 4, the inner bands 5 rotatably affix to the circular ring 3 by wrapping the ends of the bands around the circular ring in a closed loop fashion. Preferably, the inner bands overlap consecutively about the ring so that rotation of one ring in an inward or outward motion causes each of the other bands to rotate in similar manner. Any number of inner bands can be provided. However, it is preferred that a floral arranging cover 1 includes between four and twelve inner bands.

As also seen in the Figures, the floral arranging cover 1 of the present invention includes a plurality of acuate outer bands 7, which also affix to the circular ring by having their ends wrapped around the circular ring. Preferably the outer bands are provided in equal number as the inner bands and overlap one another in a similar manner as the inner 5 bands. Moreover, although the outer bands may rotate about the circular ring, it is preferred that the outer bands do not rotate which can be accomplished by affixing overlapping outer bands to one another using a wire wrap 15. The prevention of the rotation of the outer bands provides a stable planar platform which provides additional rigidity to the entire floral arranging cover.

Figure 3:
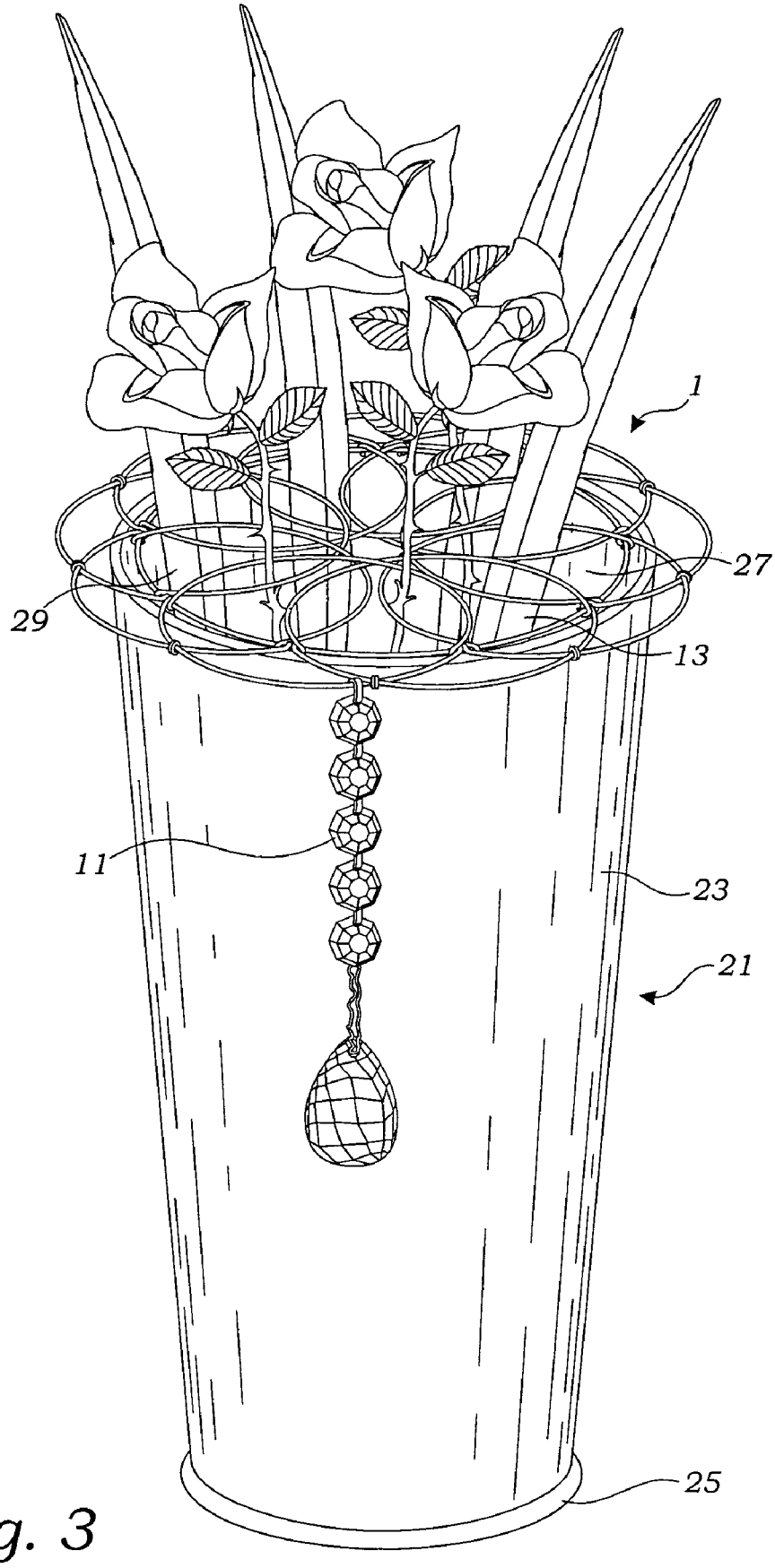
FIG. 3 is a perspective view illustrating a floral arranging cover and vase assembly providing support for a floral arrangement.
Figure 5:
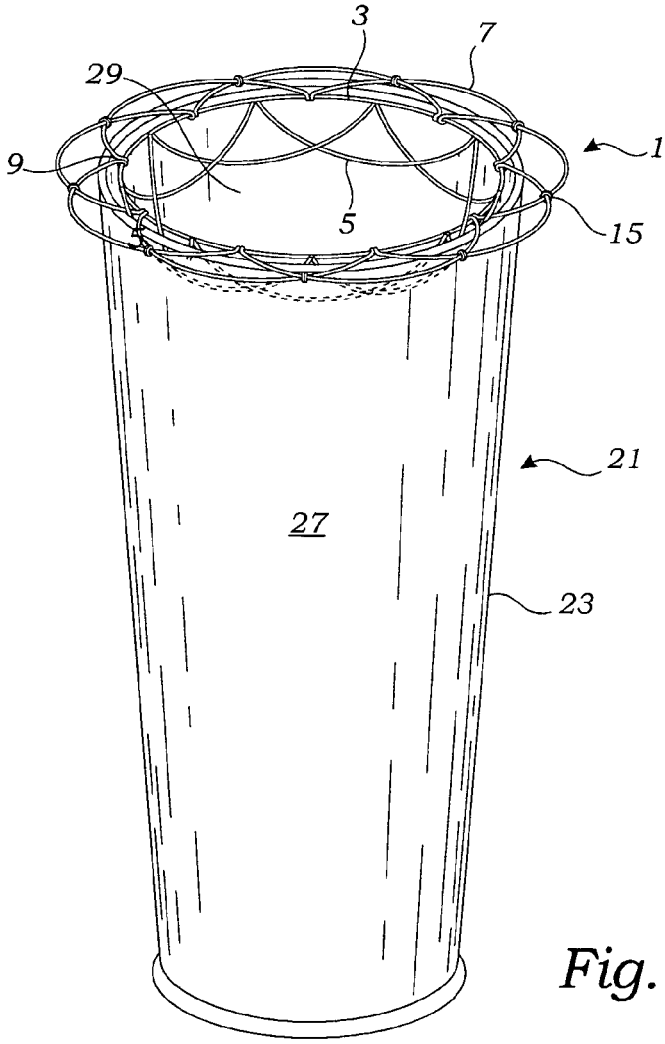
FIG. 5 is a perspective view of a floral arranging cover and vase assembly with the inner bands rotated downwardly to engage the interior of the vase.

With reference to FIGS. 3 and 5, the floral arranging cover is placed upon a vase 21. Typically, the vase 21 will have a traditional construction including a sidewall 23, a bottom 25 and an opening 29, forming a central reservoir 27. Preferably the floral arranging covers' circular ring 3 is slightly smaller than the vases' rim so that the outer bands engage and are supported on the vase's rim. As shown in FIG. 3, the overlapping inner bands provide a grid-like structure having a plurality of apertures 13 which are sized for receipt of flower and other plant stems. Moreover, the inner bands engage and support the floral and plant stems to hold the bouquet in an upright manner for display. As shown in FIGS. 4 and 5, the inner bands can also be rotated downwardly to engage the interior sidewall of the vase which provides additional stability for the floral arranging cover.

With reference to FIG. 3, once the floral arranging cover has been placed on a vase, the outer bands project outwardly from the vases' upper rim to provide a decorative appearance. Moreover, the wire-like structure of the outer bands provide a stable structure for affixing decorative elements 11. A wide variety of decorative elements may be selected. However, as shown in FIG. 3, a preferred decorative element includes faux or real precious or semi-precious stones.

While several particular forms of the invention have been illustrated and described, it will be apparent that various modifications can be made without departing from the spirit and scope of the invention. Accordingly, it is not intended that the invention be limited except by the following claims. Having described my invention in such terms to enable those skilled in the art to make understand the invention, recreate the invention and practice it, and having identified the presently preferred embodiments thereof,

The invention claimed is:

1. A floral arranging vase cover comprising:

a substantially circular ring;

a plurality of arcuate inner bands having first and second ends, said first and second ends of said inner bands being rotatably affixed to said circular ring so as to rotate interior to said circular ring; and a plurality of arcuate outer bands have first and second ends, said first and second ends of said outer bands being affixed to said circular ring exterior to said circular ring wherein said outer bands overlap one another; each of said outer bands affixed to adjacent outer bands where said outer bands overlap so as to prevent said outer bands from rotating about said circular ring.

2. A floral arranging vase cover of claim 1 further comprising a decorative element affixed and hanging down from one of said outer bands.

3. A vase and floral arranging vase cover assembly comprising:

a vase having an upper opening for receipt of plant stems;

a floral arranging cover including;

a substantially circular ring;

a plurality of arcuate inner bands having first and second ends, said first and second ends of said inner bands being rotatably affixed to said circular ring so as to rotate interior to said circular ring and within said vase opening; and a plurality of arcuate outer bands have first and second ends, said first and second ends of said outer bands being affixed to said circular ring exterior to said circular ring and exterior to said vase opening wherein said outer bands overlap one another; each of said outer bands affixed to adjacent outer bands where said outer bands overlap so as to prevent said outer bands from rotating about said circular ring.

4. A floral arranging vase cover of claim 3 further comprising a decorative element affixed and hanging down from one of said outer bands.

* * * * *